United States Patent [19]

Frink

[11] 3,943,314

[45] Mar. 9, 1976

[54] MOTION-MULTIPLYING LINKAGE-MECHANISM FOR SEALED-CASING STRUCTURES

[75] Inventor: Russell E. Frink, Pittsburgh, Pa.

[73] Assignee: Westinghouse Electric Corporation, Pittsburgh, Pa.

[22] Filed: May 14, 1974

[21] Appl. No.: 469,932

[52] U.S. Cl. ..... 200/148 A; 200/148 B

[51] Int. Cl.[2] ..... H01H 33/88

[58] Field of Search ..... 200/148 A, 148 B, 148 R, 200/148 G

[56] References Cited

UNITED STATES PATENTS

| | | | |
|---|---|---|---|
| 2,757,261 | 7/1956 | Lingal et al. | 200/148 B |
| 3,311,726 | 3/1967 | Fish, Jr. | 200/148 A |
| 3,639,712 | 1/1972 | Balmat et al. | 200/148 A |

*Primary Examiner*—Robert S. Macon
*Attorney, Agent, or Firm*—W. R. Crout

[57] ABSTRACT

An improved motion-multiplying linkage-mechanism is provided for the movable contact structure of a circuit-interrupter, particularly one of the sealed-casing type, enclosing a suitable arc-extinguishing medium, such as a highly efficient arc-extinguishing gas, such as compressed sulfur-hexafluoride ($SF_6$) gas, for example. However, where desired, the motion-multiplying mechanism of the present invention may, additionally, be utilized in vacuum interrupters, or in other types of arc-extinguishing devices where the surrounding casing structure is of a sealed type.

In accordance with the present invention, a sylphon bellows is secured to an end metallic plate of the sealed casing, and also affixed to the contact operating rod extending therewithin. A motion-multiplying mechanism, such as a lazy-tong, or pantograph-linkage assembly, is attached to the interior end of the contact operating rod, so that for a short initiating driving travel of the contact operating rod from a suitable mechanism, provided externally of the sealed-casing structure, a considerably increased length of travel for the movable contact structure is obtained.

Suitable guideways are preferably provided for guiding the linear travel of the lazy-tong linkage structure so as to effect an accurate linear driving motion of the linkage.

3 Claims, 29 Drawing Figures

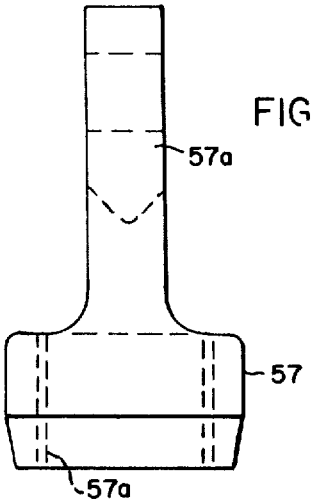
FIG. 12
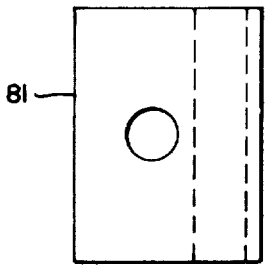
FIG. 14
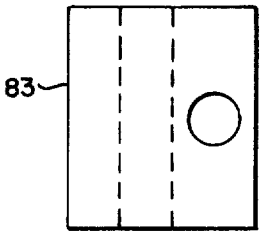
FIG. 15
FIG. 13
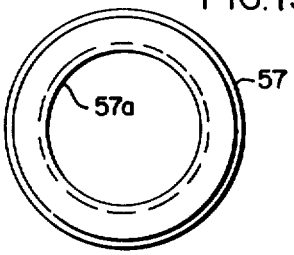
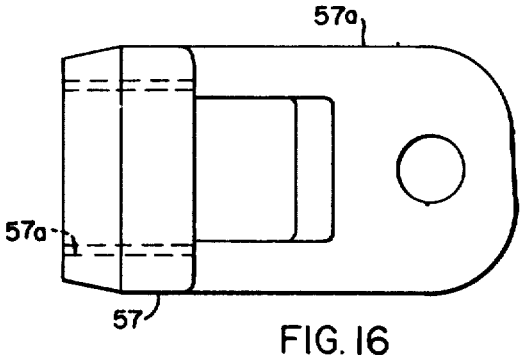
FIG. 16

FULLY OPEN CIRCUIT POSITION

CLOSED POSITION

MOTION-MULTIPLYING LINKAGE-MECHANISM FOR SEALED-CASING STRUCTURES

CROSS-REFERENCES TO RELATED APPLICATIONS

Reference may be had to the following patent applications: U.S. patent application filed May 14, 1974 Ser. No. 469,931 entitled "Improved Energy-Storage Operating Mechanisms For Circuit-Interrupting Structures Alone And Also For Circuit-Interrupting Structures Utilizing Serially-Related Disconnecting-Switch Structures Therewith" by Russell E. Frink and Stanislaw A. Milianowicz; U.S. patent application filed May 13, 1974, Ser. No. 469,586 by Stanislaw A. Milianowicz; U.S. patent application filed May 3, 1974, Ser. No. 466,745 by Steven Swencki and Stanislaw A. Milianowicz; U.S. patent application filed June 10, 1974, Ser. No. 478,141 by Russell E. Frink entitled "Hermetic Seals for Insulating Casing Structure"; and U.S. patent application filed May 8, 1974, Ser. No. 468,332 entitled "Quick-Acting Movable Operating Column Tripping Device" by Frink et al. all of the foregoing patent applications being assigned to the assignee of the instant patent application.

BACKGROUND OF THE INVENTION

Continued growth of urban load densities and the scarcity of available space for substation construction indicates a future market for metal-clad switchgear in voltage ratings above 15 KV. Circuit-breakers for use in this metal-clad switchgear range must fulfill a number of requirements, among which are reliability, long life, minimum maintenance, small size, quiet operation, and reasonable cost. The characteristics of sulfur-hexafluoride $SF_6$ puffer-type interrupters make them well suited for this application. However, it is felt that for the best customer acceptance the interrupters preferably should be hermetically sealed.

Load-break disconnecting switches are quite old in the art, and in some instances employ an interrupting unit having separable interrupting arcing contacts in electrical series with the disconnecting switchblade to interrupt the incident arcing at the separable interrupting arcing contacts instead of at the disconnecting switch contacts. The prior art devices function to first effect initial opening of the interrupting assembly, and subsequently, effect opening of the serially related disconnecting switchblade without arcing thereat to completely isolate the circuit. U.S. Pat. No. 2,769,063, issued Oct. 30, 1956, to H. J. Lingal, is typical of such series-type devices. Other load-break disconnecting devices, which utilize a swinging movement of the free end of the disconnecting switchblade to effect the operation of the operating mechanism for the interrupting element, are set forth, for example, in U.S. Pat. No. 2,889,434, issued June 2, 1959, to H. J. Lingal, and assigned to the assignee of the instant application.

In some of the aforesaid load-break disconnecting switches, an insulating gas, such as sulfur-hexafluoride ($SF_6$) gas, for example, is utilized for arc-extinguishing purposes. In still other devices, such as set forth in U.S. Pat. No. 2,737,556, issued Mar. 6, 1956, to MacNeill et al., a suitable arc-extinguishing liquid, such as oil, for example, may be utilized to advantage, although, as is well known, oil gives rise to the hazard of inflammability if the oil containers, or oil casing, should for some reason, fracture due to earthquake shock, vibration, gun shot, or from any other causes, and spill flammable oil into the surrounding switchyard area.

Modern circuit-breakers are efficient and reliable devices and perform their duties adequately. However, they are large and expensive; and in many cases, economies can be achieved with less-expensive devices. Such devices have been available for serveral years and range from load-interrupter switches, with interrupting ratings approximating their continuous current-carrying capabilities, to devices which can interrupt a few thousand amperes with modest transient-recovery voltage capabilities.

Over the past few years, development work performed with sulfur-hexafluoride ($SF_6$) gas puffer-type circuit-interrupters has led to improvements in these puffer gas-type devices. Some of these improvements have been incorporated into the medium-fault-interrupting class devices, such as set forth in the instant patent application, thus expanding their field of application. Some of the advantages attained by the invention set forth herein include:

a. Simplicity of construction;
b. 10,000 amperes interrupting capacity at 169 KV, for example, on a single contact break without using shunt capacitors or resistors;
c. Transient-recovery capability on bus-faults corresponding to capability of circuit-breakers at maximum rating;
d. Full insulation strength across the open contacts of the interrupter without requiring an open disconnecting switch;
e. High-speed circuit-making and breaking in pressurized sulfur-hexafluoride $SF_6$ gas which eliminates any arcing in air; and,
f. Low noise level during switch operation.

Accordingly, it is desirable to improve upon the operating mechanisms of such load-break disconnecting switches or interrupter switches, per se, when used alone, and the present invention is particularly concerned with an improved motion-multiplying mechanism and having wide areas of application particularly for operating movable contacts in hermetically sealed casing structures.

SUMMARY OF THE INVENTION

In accordance with the present invention, there is provided a sealed-casing interrupter structure in which the advantages of a metallic sylphon bellows is desired, but where the length of travel of the movable contact structure is considerably greater than would be obtained by a like movement of the inner end of the metallic sylphon bellows. Accordingly, a motion-multiplying linkage mechanism is desired to effect a considerably greater length of opening and closing travel of the movable contact structure, relative to a very short driving initiating movement of the contact operating rod extending into the hermetically sealed casing and actuated externally of the casing by a suitable operating mechanism, having a relatively short driving stroke, say of the order of roughly one inch, for example.

By using a lazy-tong motion-multiplying linkage structure, a considerably enhanced length of travel of the movable contact structure is obtained as a result of a relatively short initiating driving stroke of the contact operating rod extending externally of the sealed-casing structure.

BRIEF DESCRIPTION OF THE DRAWINGS

FIG. 12 is a side-elevational view of a moving rod-end member;

FIG. 13 is an end-elevational view of the rod-end member of FIG. 12;

FIGS. 14 and 15 are side-elevational views of the metallic mounting blocks used in my improved construction;

FIG. 16 is a side-elevational view of another rod-end member;

DESCRIPTION OF THE PREFERRED EMBODIMENTS

Modern circuit-breakers are efficient and reliable devices and perform their duties adequately. However, they are large and expensive; and in many cases, economies can be achieved with less-expensive devices. Such devices have been available for several years and range from load-interrupter switches, with interrupting ratings approximating their continuous current-carrying capabilities, to devices which can interrupt a few thousand amperes with modest transient-recovery capabilities.

Over the past few years, development work performed with $SF_6$ gas puffer-type circuit-interrupters has led to improvements in these gas-type devices. Some of these improvements have been incorporated into the medium-fault-interrupting class devices, such as set forth in the instant patent application, thus expanding their field of application. Some of the advantages attained by the invention set forth herein include:

a. Simplicity of construction;
b. 10,000 amperes interrupting capacity at 169 KV, for example, on a single-break interrupter without using shunt capacitors or resistors;
c. Transient-recovery capability on bus-faults corresponding to capability of circuit-breakers at maximum rating;
d. Full insulation strength across the open contacts of the interrupter without requiring an open disconnecting switch;
e. High-speed circuit-making and breaking in pressurized $SF_6$ gas which eliminates any arcing in air; and
f. Low noise level during switch operation.

Figure 1:
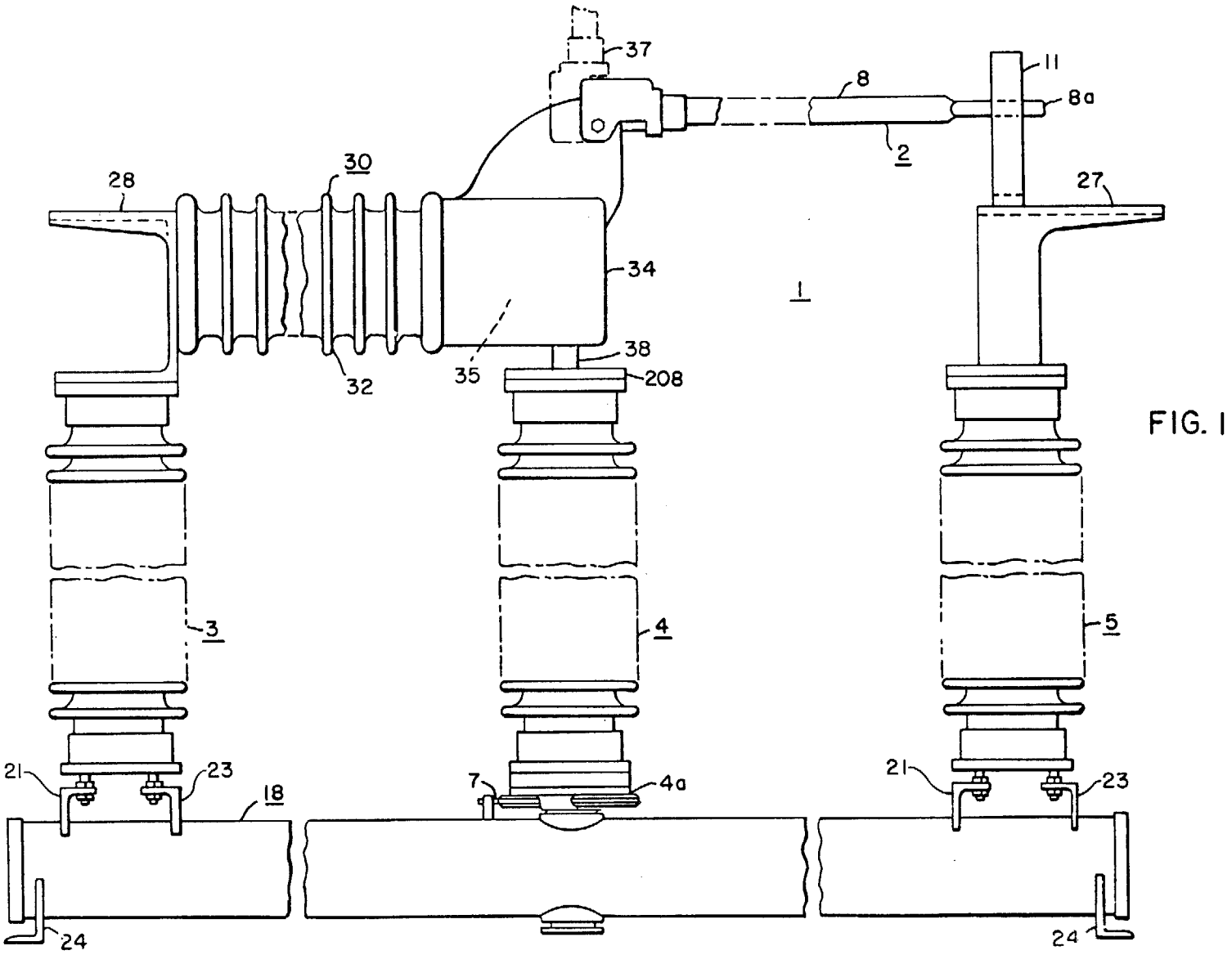
FIG. 1 is a side-elevational view of one pole-unit of a three-phase circuit-interrupting assemblage having a serially-related disconnecting switchblade, utilizing the principles of the present invention, the device being shown in the closed-circuit position.

Referring to the drawings, and more particularly to FIG. 1 thereof, the reference numeral 1 generally designates a circuit-interrupting structure including three upstanding post insulators 3, 4 and 5. The two end post insulators 3 and 5 are stationary, whereas the middle post insulator 4 is rotatable, being driven from its lower end by an operating-crank 7 connected to any suitable operating mechanism. Such an operator may be a motor-driven device, or in certain instances the crank-operator may be manually driven.

FIG. 1 also shows the base supporting structure 18, which may be of cylindrical form, and is supported by welded brackets 24 to cooperating channel members, which face inwardly. Extending between each end post insulator 3 and the middle rotatable driving post insulator 4 is the improved interrupting assembly, or a circuit-interrupter 30 of my invention which encloses one or more serially-related separable contact structures 31 (FIG. 3) of the gas-puffer type set forth in FIGS. 2 and 3 of the drawings, which may, for example, use sulfur-hexafluoride ($SF_6$) gas.

Referring again to the drawings, and more particularly to FIG. 1 thereof, it will be observed that one application of the present invention is in connection with a circuit-interrupting device 30 having a serially-related disconnecting switchblade 8 associated therewith for obvious safety reasons. Those skilled in the art may call such a structure a "load-break disconnecting switch", in which the circuit-interrupting structure 30 is utilized to actually break the load-current passing through the device 1, and the function of the disconnecting switchblade 8 itself is merely to effect a visible open-circuit condition of the device 1, so that maintenance people may work upon the connected electrical line without fear of high-voltage shock occurring.

Figure 3:
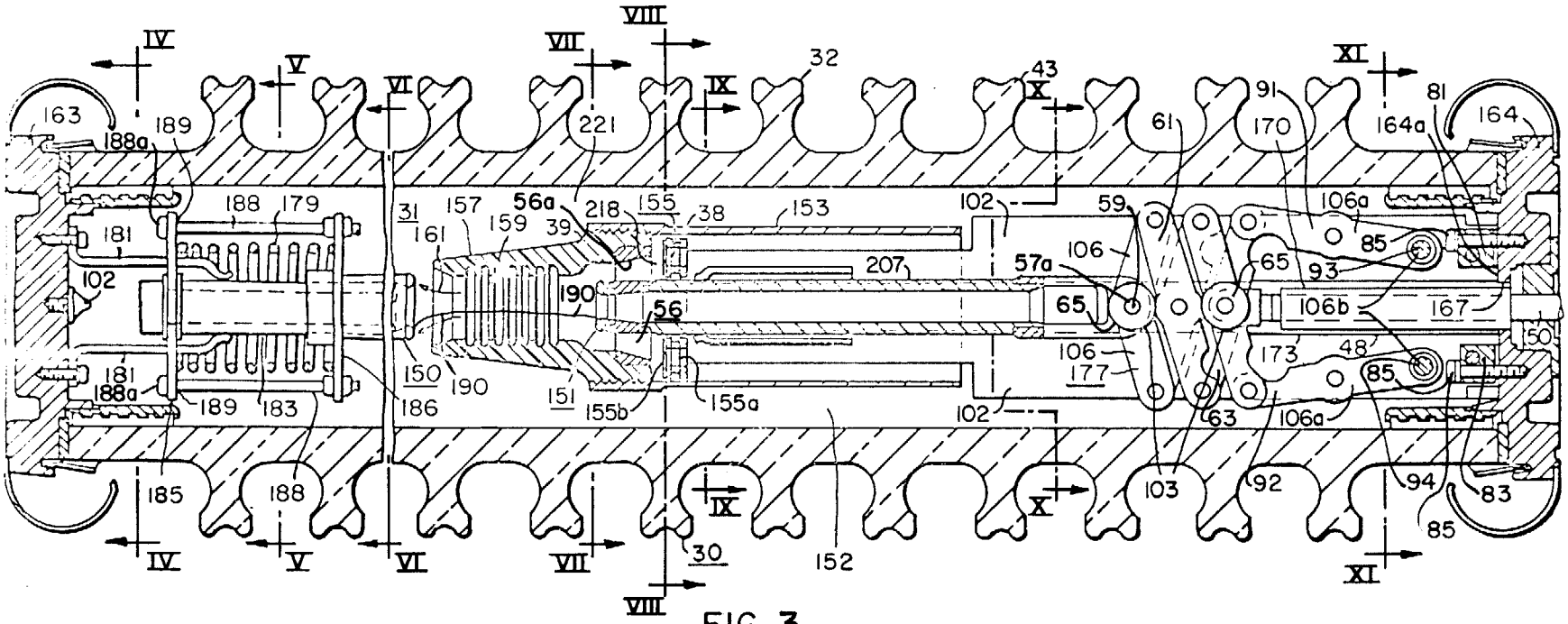
FIG. 3 is a longitudinal sectional view taken at right angles to that of FIG. 2, but illustrating the disposition of the several contact parts in the fully-open-circuit position of the circuit-interrupter, but for illustrative purposes, the gas-flow being indicated by arrows within the gas-nozzle structure, and the location of the established arc being indicated.

As illustrated in FIG. 1, it will be observed that there is provided a lower-disposed base assembly 18 having supporting brackets 24 and having welded to the upper portion thereof additional brackets 21, 23 to fixedly support the insulating column structures 1 and 5. With reference to FIG. 3, it will be observed that extending upwardly from the elongated base support 18, which may be of generally tubular configuration, if desired, are stationary insulating columns 3 and 5, which support a right-hand line-terminal 27 and a left-hand load-terminal 28, with a circuit-interrupting assemblage 30 enclosed within a hermetically-sealed housing 32 extending between the load-terminal 28 and a generally box-shaped metallic mechanism housing 34, which has a mechanism 35 disposed therewithin. Electrically interconnecting the metallic mechanism housing 34 and the line-terminal 27 is a swinging disconnecting switchblade 8, which provides an open-circuit visible gap between the line-terminal 27 and the mechanism housing 34 in the fully open-circuit position of the circuit-interrupter 30. The dotted lines 37 indicate, generally, an upstanding open-circuit position of the disconnecting switchblade 8, as well known by those skilled in the art.

It will be observed that the end insulating columns 3 and 5 are stationary, merely providing a supporting function, whereas the middle insulating column 4 is rotatable, and has an operating function, having an upper extending shaft-portion 38, which extends interiorly within the mechanism housing 34, and serves to actuate the operating mechanism 35 provided therein. The upstanding operating shaft 38 extends, moreover, upwardly through the mechanism housing 34, terminating in a crank-arm 40 (FIG. 1), and actuates the opening swinging motion of the disconnecting switchblade 8. In other words, the upper end of the operating shaft 38 effects rotative opening and closing movements of a crankarm 40, which, in turn, effects rotation and swinging opening and closing motions of the serially-related disconnecting switchblade 8.

Figure 2:
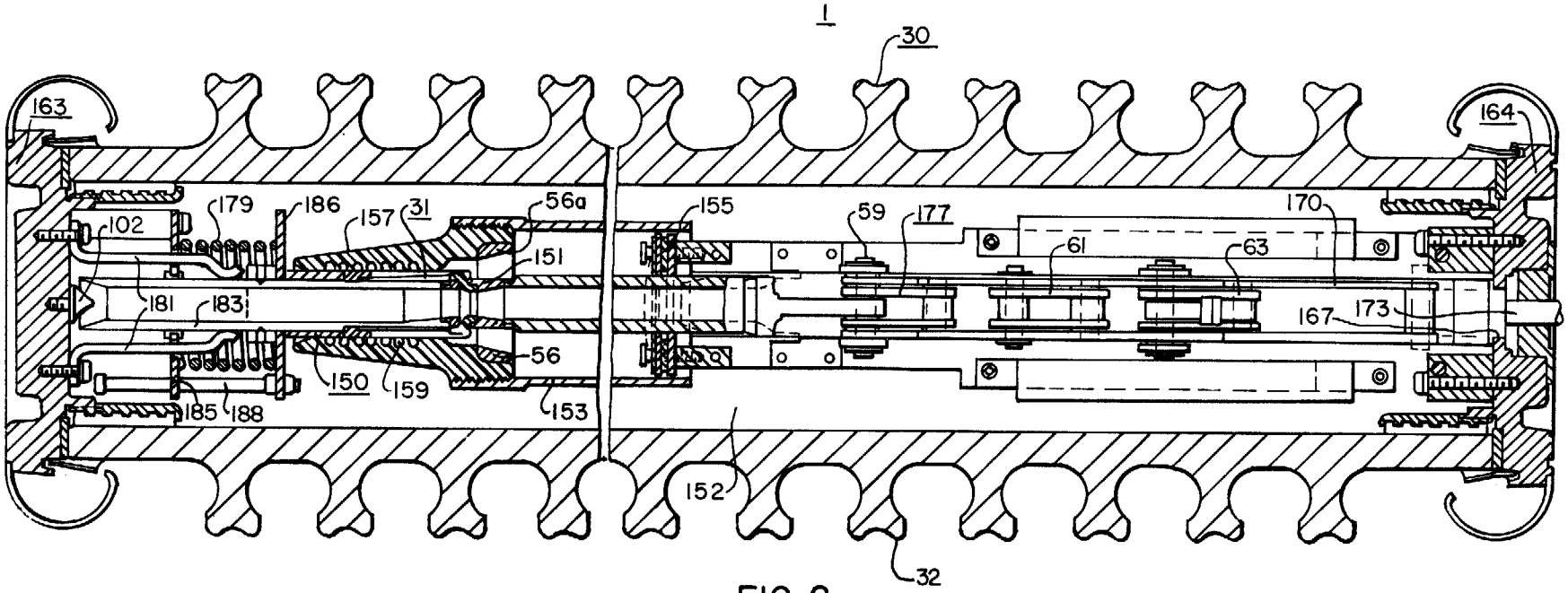
FIG. 2 is an enlarged longitudinal sectional view taken axially through the circuit-interrupter unit of FIG. 1 extending between the two upstanding column structures of FIG. 1, the separable contact structure being illustrated in the closed-circuit position.

With reference to FIGS. 2 and 3 of the drawings, it will be observed that the separable contact structure 31 comprises a spring-biased stationary contact 150 and a movable tubular contact structure 151, which carries an operating cylinder 153 over a relatively stationary piston structure 155. In addition, the movable tubular contact 151 carries an orifice structure 157 having a corrugated opening 159 therethrough, through which gas 152, such as sulfur-hexafluoride ($SF_6$) gas, for example, is forced during the opening gas-moving motion of the operating cylinder 153 over the stationary piston structure 155 to thus force the gas to flow in the direction indicated by the arrows 161 in FIG. 3.

Generally, the circuit-interrupting assemblage 30 includes a longitudinally-extending casing 32 of insulating material having sealed to the ends thereof metallic end-cap casting structures 163, 164. The left-hand metallic end-cap structure 163 is electrically connected to the left-hand load-terminal 28 of the switch structure 1. The right-hand metallic end-cap structure 164 has an opening 167 extending therethrough, which accommodates a metallic flexible sylphon bellows 170 and a metallic contact operating rod 173. One end of the metallic sylphon bellows 170 is sealed to the inner face of the opening 167 of the metallic end-cap structure 164. The other, or left-hand end of the metallic sylphon bellows 170, is secured in sealing relationship to the movable metallic contact operating rod 173, which extends into the mechanism compartment (not shown) and is actuated by the operating mechanism 35, constituting no portion of the present invention. This mechanism is described in U.S. patent application filed May 14, 1974, Ser. No. 469,931 by Russell E. Frink and Stanislaw A. Milianowicz, and assigned to the assignee of the present application.

In the closed-circuit position of the device, shown in FIG. 2, the lazy-tong linkage mechanism 177 is somewhat extended, and forces the movable tubular contact 151 into closed valve-like contacting engagement with the stationary tubular contact 150, and somewhat compressing the contact-compression spring 179. Relatively stationary contact fingers 181 slide upon the supporting cylinder 183, which carries the relatively stationary contact 150 at its right-hand end in the manner illustrated in FIG. 3 of the drawings.

Figure 4:
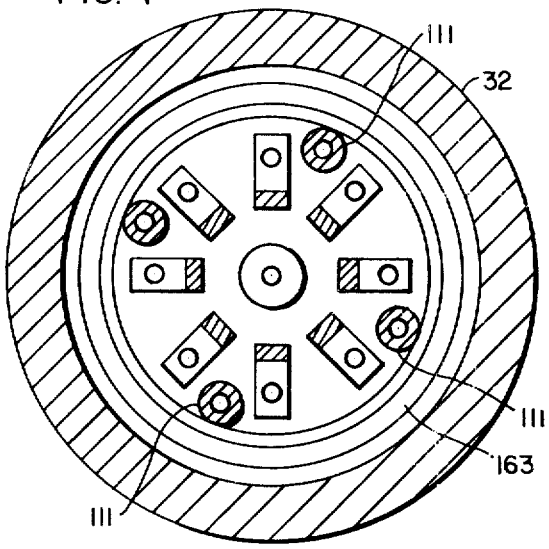
FIG. 4 is a sectional view taken substantially along the line IV—IV of FIG. 3.
Figure 5:
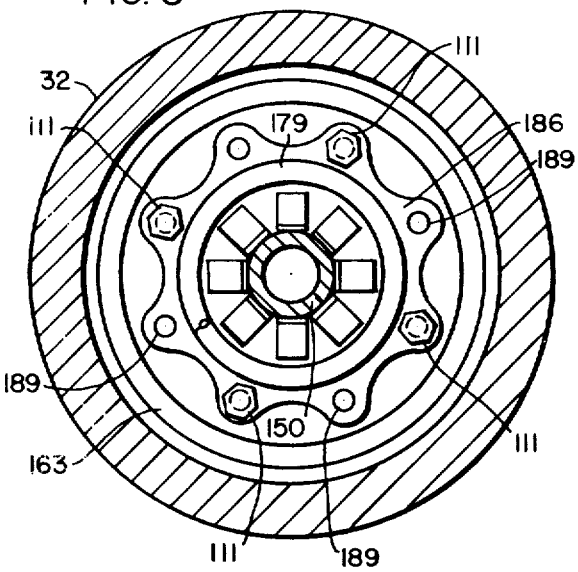
FIG. 5 is a sectional view taken substantially along the line V—V of FIG. 3.
Figure 6:
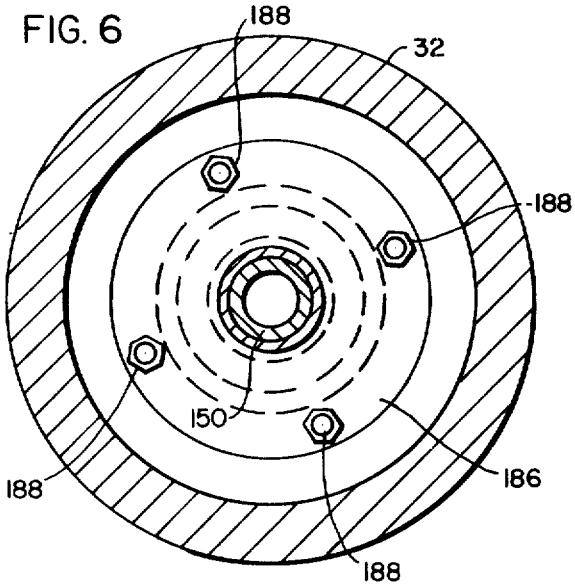
FIG. 6 is a sectional view taken substantially along the line V—V of FIG. 3.
Figure 7:
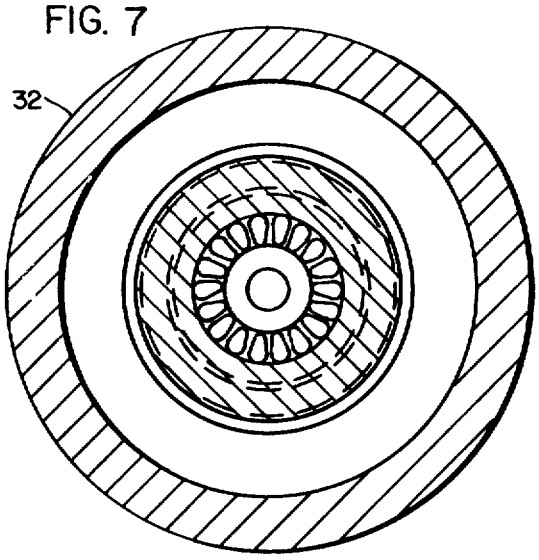
FIG. 7 is a sectional view taken substantially along the line IX—IX of FIG. 3.
Figure 8:
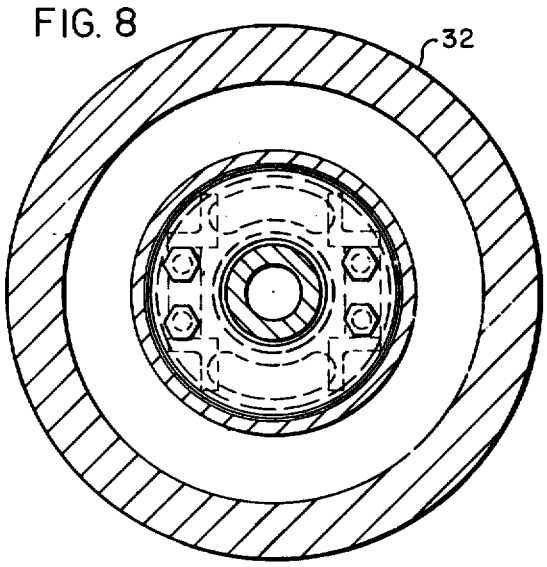
FIG. 8 is a sectional view taken substantially along the line VIII—VIII of FIG. 3.
Figure 9:
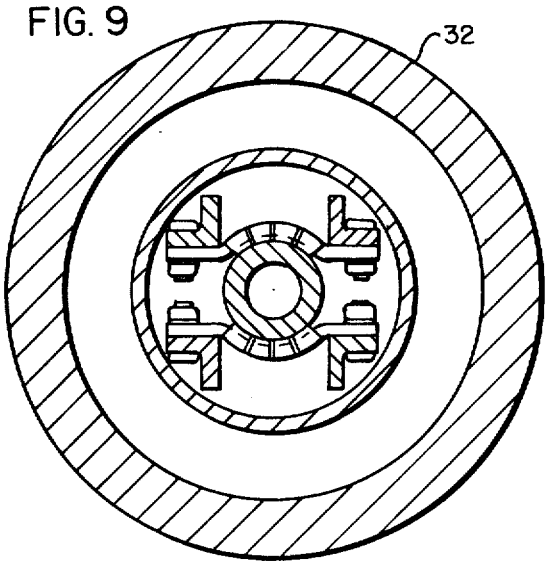
FIG. 9 is a sectional view taken substantially along the line IX—IX of FIG. 3.

A support plate 186 (FIG. 5) is fixedly supported by post-means 111 (FIG. 4) from the left-hand metallic end-cap structure 163, and the contact-compression spring 179 seats thereon. The right-hand end of the contact compression spring 179 seats upon a movable spring seat 186 (FIG. 6), which is affixed to a plurality of spring-rods 188, which are capable of sliding through openings 189 provided in the stationary spring seat 185 (FIG. 7).

As will be obvious from an inspection of the interrupter 30 of FIGS. 2 and 3, extension of the lazy-tong linkage 177 brings the tubular contacts 150, 151 into closed contacting valve-like engagement, as shown in FIG. 2, to close the electrical circuit through the device 30, whereas retraction of the lazy-tong linkage 177, as caused by rightward movement of the operating rod 173 driven from the mechanism 35, will effect opening of the tubular contact structure 150, 151 with concomitant piston-driving gas-flow 152 action through the tubular orifice 157 to effect extinction of the arc 190, which is established between the contacts, as shown in FIG. 3.

Although FIG. 3 shows the fully open-circuit position of the tubular contact structure 31, nevertheless for purposes of clarity, the position of the arc 190 has been indicated to show that it is acted upon by the gas-flow forced in the direction of the arrows 161 by the movable insulating operating cylinder 153 sliding longitudinally over the stationary piston structure 155.

It will be observed that the relatively stationary contact assembly 150 comprises a surrounding slotted contact-sleeve portion **150*a*, which is secured, as by brazing, to an intermediate portion of the tubular relatively stationary contact, as at 150*b*. The support plate 186 also, of course, serves as a spring seat for the contact-biasing spring 179, as shown in FIGS. 2 and 3 of the drawings. To deflect the gas-flow through the relatively stationary contact, preferably a deflector button 102 is secured in the left-hand metallic end plate 163 of the circuit-interrupter, as shown in FIGS. 2 and 3**.

Preferably, a metallic cooler assembly 56 is provided affixed to, and movable with the tubular movable venting contact 151. The metallic cooler 56 is provided by an annular metallic member having a plurality of circumferential holes **56*a* provided therethrough to cool the compressed gases entering the arcing region. The cooler assembly 56 is affixed, as by brazing, for example, to the external surface of the movable tubular contact 151 and is surrounded by the insulating nozzle structure 157. Externally of the nozzle structure, as more clearly illustrated in FIG. 3, is the insulating operating cylinder 153**, which moves with the nozzle and movable tubular venting contact, as a unitary assembly, during the opening operation.

Figure 10:
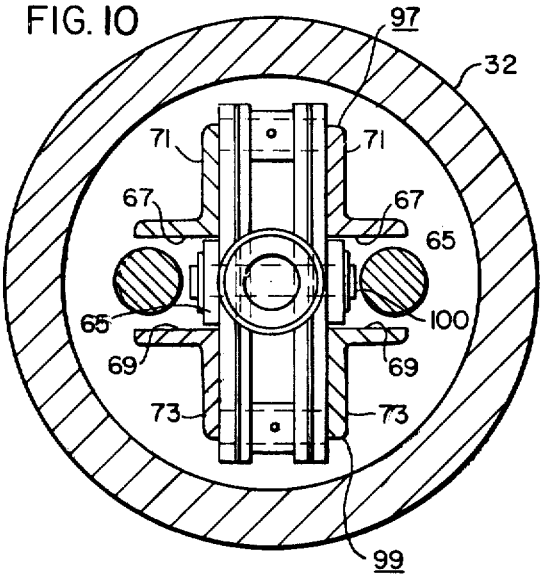
FIG. 10 is a sectional view taken substantially along the line X—X of FIG. 3.

The right-hand end of the movable tubular venting contact 151 is fixedly secured, as by a threaded connection, to a rod-end member 57, more clearly illustrated in FIGS. 12, 13 and 16 of the drawings. The rod-end member 57 has an apertured extension **57*a* integrally provided therewith, which is secured, as by a pivot-pin 59, to the left-hand end of a lazy-tong linkage assembly, or pantograph assembly 177, comprising a plurality of interconnected pivoted links 61, 63, and guided by a plurality of roller members 65, which move along the opposing confronting flange-portions 67, 69 of the guide-angle members 71, 73 (FIG. 10). The right-hand ends of the guide-angle members 71, 73 are secured to a plurality of metallic mounting blocks 81, 83 which, in turn, are secured by mounting bolts 85 to the right-hand metallic end plate 164 of the interrupter assembly 30, as shown in FIG. 3**.

Figure 11:
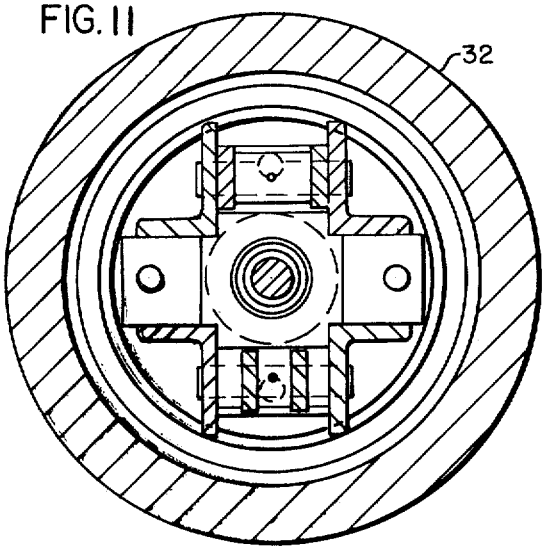
FIG. 11 is a sectional view taken substantially along the line XI—XI of FIG. 3.
Figure 19:
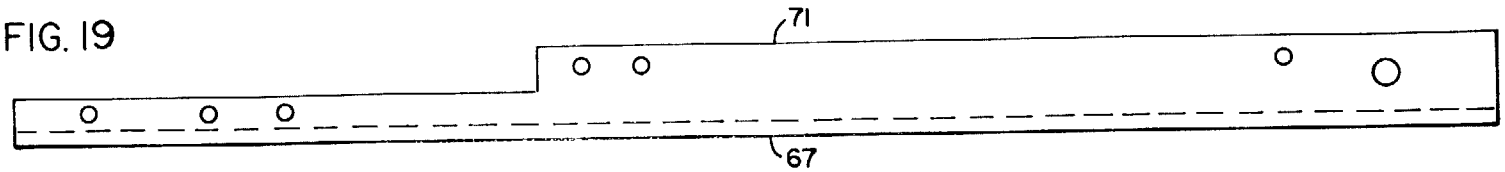
FIG. 19 is a top plan view of the guide-angle member of FIG. 17.
Figure 17:
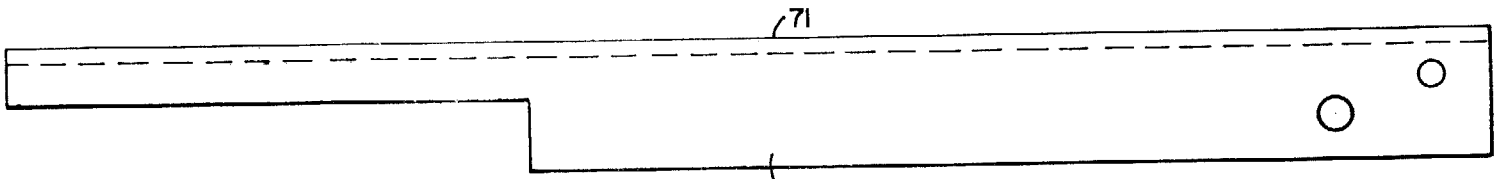
FIGS. 17 and 18 are, respectively, side-elevational and end views of metallic guide-angle members utilized in the improved interrupter construction for guiding the axial expanding movement of the lazy-tong linkage.

The right-hand end of the lazy-tong, or pantograph linkage assembly 177 includes two pairs of guide links 91, 92, the right-hand ends of which are stationarily pivotally secured, as by two stationary pivot pins 93, 94 between the upper and lower pairs of angle-standards 97, 99 which additionally provide confronting flanged surfaces to guide pairs of guide rollers 65 associated with the pivot-pin connections 100 of the several links 61, 63 constituting the lazy-tong assemblage 177. This construction is more clearly illustrated in FIGS. 10 and 11, wherein it will be observed that the guide-rollers 65 are spaced laterally apart, being provided on the same movable pivot pins 100, and each movable guide-roller 65 being guided between the flanged surfaces 67, 69 of a pair of the angle-standards 97 or 99.

The left-hand ends of the four stationary angle-standards are reduced in width to accommodate the longitudinal travel of the insulating operating cylinder 153, as more clearly illustrated in FIG. 3.

To effect the longitudinal extension and contraction of the lazy-tong assemblage 177, the contact operating rod 151 has a rod-end 57 which is pivotally connected to the first pivot point of the lazy-tong assemblage, as indicated by the reference numeral 59. Since the two pairs of guide-links 91, 92 are stationarily pivoted at the points 93, 94, the inward and outward movement of the contact-operating rod-end 57A driven by the contact operating rod 173 will effect outward extension and inward contraction of the lazy-tong linkage assemblage 177 in an obvious manner. The pivoted links 61, 63 themselves will, of course, be guided by the lateral confronting flange surfaces 67, 69 of the two pairs of angle-standards 97, 99 in a manner more clearly illustrated in FIG. 10.

The fixed piston assembly 155 is fixedly secured to the left-hand ends of the metallic angle-standards 97, 99 in a manner more clearly illustrated in FIG. 3. A one-way acting valve structure 105 is associated with the fixed piston structure 155, so that during the compressing operation, the valve structure 105 closes, whereas during the contact closing operation, the valve structure 105 will then open to permit gas flow from the ambient 65 within the casing 32 to flow into the compression region 66 within the operating cylinder member 153.

The left-hand end of the lazy-tong assemblage 177 has the thrust member 57, which is fixedly secured to the right-hand end of the moving contact assembly 151. This structure is shown more clearly in FIG. 3 of the drawings.

Figure 23:
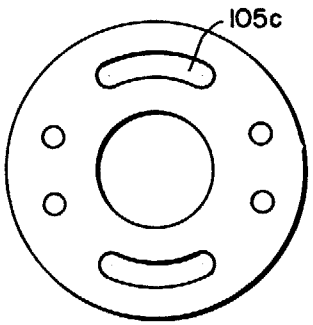
FIGS. 23 and 24 are additional views of component parts of the valve structure.
Figure 24:
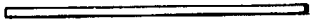
Figure 20:
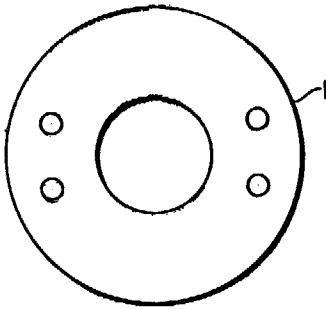
FIGS. 20, 21, and 22 are top plan and side views of the spring-washer construction associated with the valve member mounted on the fixed piston.
Figure 21:
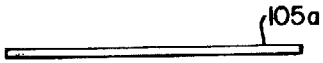
Figure 22:
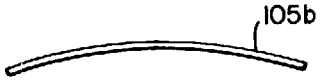
Figure 18:
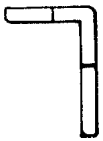

The one-way acting valve structure 105 comprises an annular valve **105*a* and an annular valve-spring 105*b*, both being supported by four post supports, the latter being secured to the four mounting blocks. The valve-spring 105*b* normally holds the annular valve 105*a* over the valve openings, designated by the reference numeral 105*c* in FIGS. 23, 24 so that during the compression stroke, the valve structure 105 remains closed. During contact closing, on the other hand, as mentioned, the gas pressure conditions will deflect the valve-spring 105*b* and enable the valve openings 105*c* to be opened to permit gas flow into the compression chamber 66**.

The cooler assembly 56 has an important function during arcing, namely the cooling of the arcing gases, which may tend to backup into the compression chamber 66 during high instantaneous values of arcing current. On the other hand, when the instantaneous value of the arcing current decreases, to thereby lower the arcing pressure, the gas will return through the metallic cooler assembly 56, augmented by a fresh gas flow emanating from the compression chamber 66, and collectively will be forced into the arc 190, to be exhausted in both directions through the relatively stationary venting contact structure 150 and also in the opposite direction through the moving venting contact structure 151, as indicated by the arrows 161.

A plurality of contact fingers 131 are provided, which bear laterally inwardly against the outer side surface of the movable tubular venting contact 151 to transmit current flow therefrom to the stationary metallic standards 71, 73, and thereby to the right-hand end closure plate 164 of the interrupter.

It will be noted that during the opening operation that the compressed gas will pass longitudinally through both tubular vented separable contacts for rapid arc extinction, with the carrying of the terminal ends of the arc 190 within the hollow tubular venting contacts themselves, to thereby attenuate the arc and effect the extinction thereof, as shown in FIG. 3.

By mounting the relatively stationary contact structure 150 in a resilient manner to enable a predetermined following movement of the stationary contact structure with the movable contact structure 151 prior to separation therebetween, a desirable predetermined pressure-buildup is generated within the puffer-operating cylinder 153, and trapped therein, by such contact valve action, so that an adequate pressure-buildup is attained before actual separation of the two cooperable venting contacts 150, 151, and thereby release of the gas pressure built up within the puffer operating cylinder 153. When this occurs, the gas is suddenly released by the separation of the two contacts 150, 151, and this compressed gas then rapidly flows through both separable stationary and movable tubular venting contacts 150, 151 to bring about quick interrupting extinguishing action exerted upon the drawn arc 190 within the contacts.

To effect a rapid opening travel of the movable contact structure and the movable operating cylinder, preferably, the lazy-tong motion multiplying mechanism 177 is provided interiorly of the casing structure 32, which is preferably hermetically sealed by the sylphon bellows; and the operating rod 173 extends externally of the casing structure 32 through a sealed opening 167 (FIG. 3) adjacent the right-hand end, which supports the relatively fixed piston structure 155.

By way of retrospect, beginning with the interrupter in the closed-circuit position, as illustrated in FIG. 2, it will be observed that contraction of the lazy-tong linkage device 177 results in a rightward opening movement of the insulating operating cylinder 153 over the stationary piston structure 155. During this initial rightward opening movement of the movable tubular contact structure 151 and the insulating operating cylinder 153, there will, of course, be a following take-up of the lost-motion travel of the relatively stationary contact 150 by virtue of the contact-compression spring 179 and the spring rods 188, until the heads 188*a* on the spring-rods 188 come into contact with the stationary support plate 185. At this point in time, the following movement of the relatively stationary contact 150 ceases, and thereafter an arc 190 is established between the two tubular contacts 150, 151, the movable contact 151 thereafter continuing its opening motion toward the right.

It will be observed that during this initial following travel of the relatively stationary contact 150, a desirable precompression of the gas occurs within the region 66 within the operating cylinder 153. At the time of contact separation, this desirable precompression of the gas exists, and at this point in time gas flow occurs through both of the tubular contacts, now separated, in the manner illustrated by the arrows 161.

Since the bore within both tubular contacts is of relatively equal size, there will, consequently, occur a general equalization of exhausting gas flow through both of the tubular contacts 150, 151 in the direction indicated by the arrows 161.

The ratings of interrupting device 30 incorporating the improved inventions of the present application is as follows:

| | |
|---|---|
| Rated maximum voltages | 121, 145 and 169 kV |
| Rated continuous current | 1200 A. |
| Rated symmetrical interrupting current | 10,000 A. |
| Rated TRV capability at max. int. current | 1.7 kV per $\mu$ S |
| Momentary current, RMS asymmetrical | 61,000 A. |
| 4-second current, RMS symmetrical | 40,000 A. |
| Closing current, RMS asymmetrical | 30,000 A. |
| Interrupting time (60 Hz basis) | 5 cycles |
| Contact opening speed 15.5 ft. per sec. | (4.7 m per sec.) |
| Contact closing speed 14 ft. per sec. | (4.3 m per sec.) |
| Total operating time (open or close) | 4 sec. |
| Control voltages | 48V. dc, 125V. dc and 250V. dc |

Figure 26:
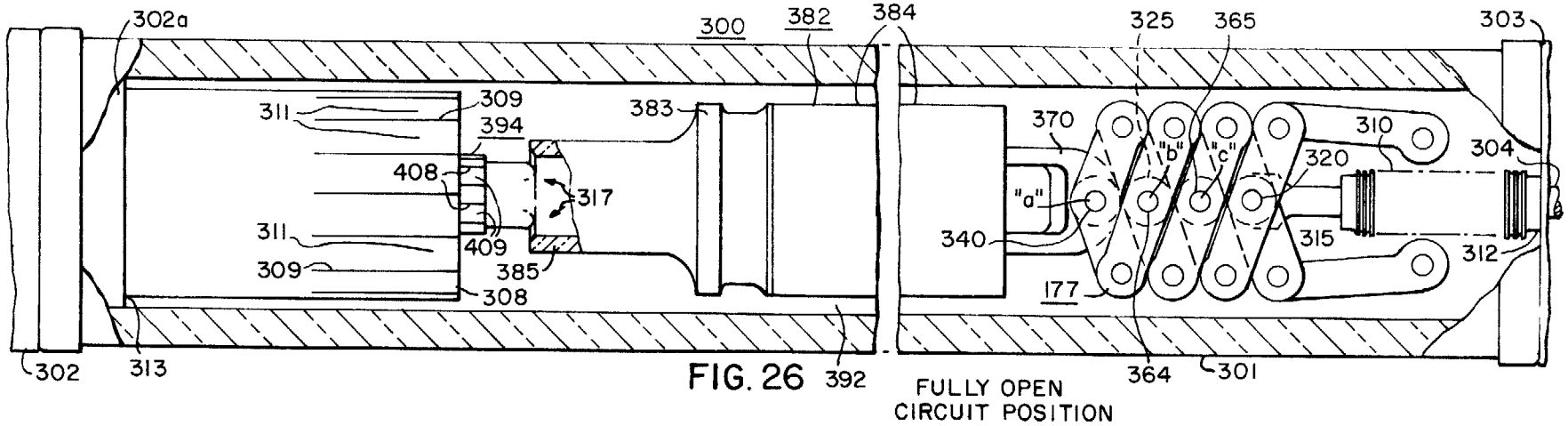
FIG. 26 is a view similar to that of FIG. 25 but illustrating the disposition of the several parts with the lazy-tong linkage being illustrated in the collapsed or retracted position.
Figure 25:
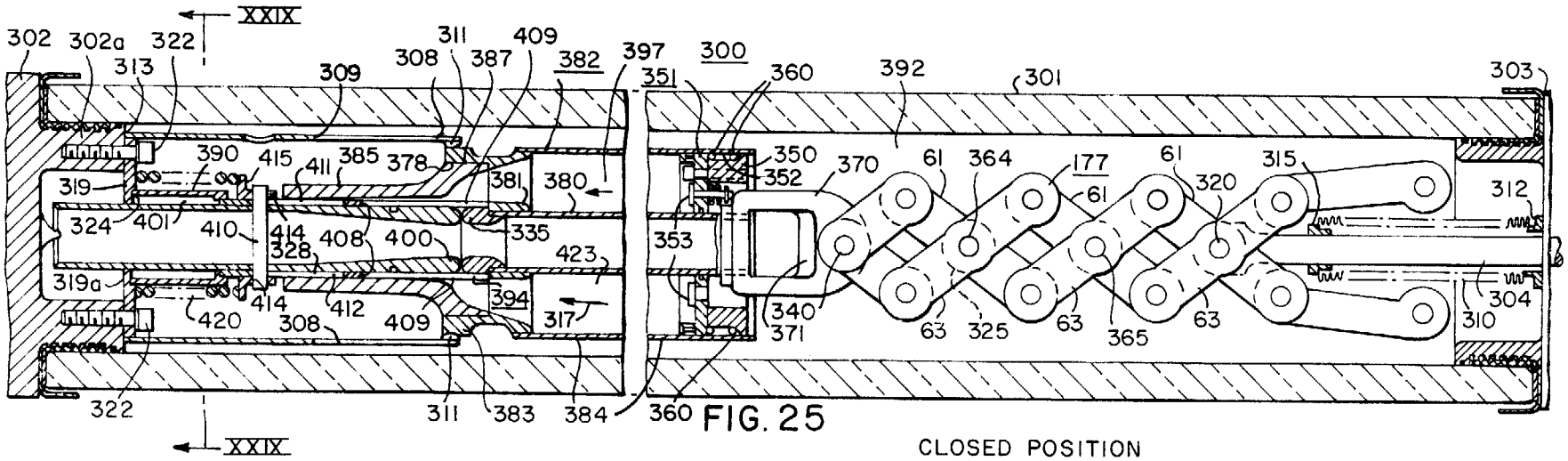
FIG. 25 is a vertical sectional view taken longitudinally through a modified type of circuit-interrupter construction, with the lazy-tong linkage shown in an extended position and with the contact structure being illustrated in the closed circuit position.
Figure 27:
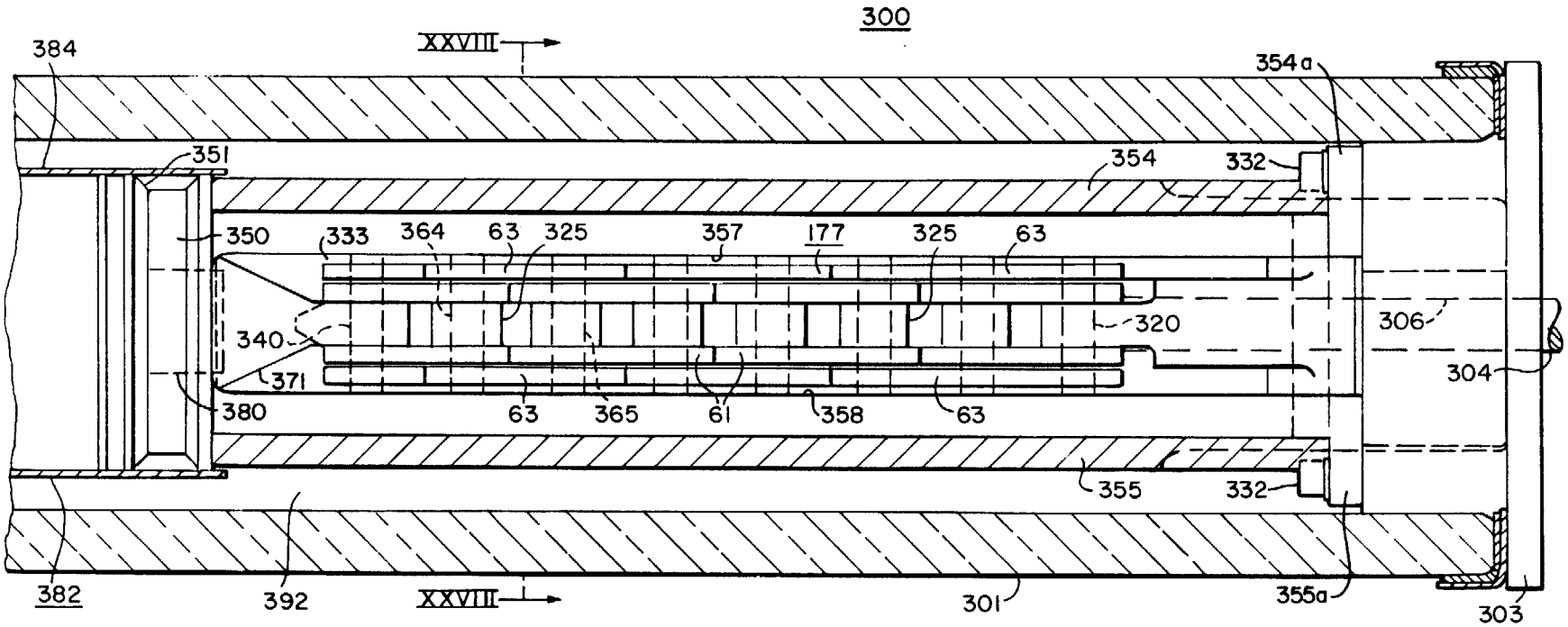
FIG. 27 is a fragmentary longitudinal view taken substantially at right angles to the views of FIGS. 25 and 26 illustrating the linkage assembly in the extended or closed circuit position.
Figure 28:
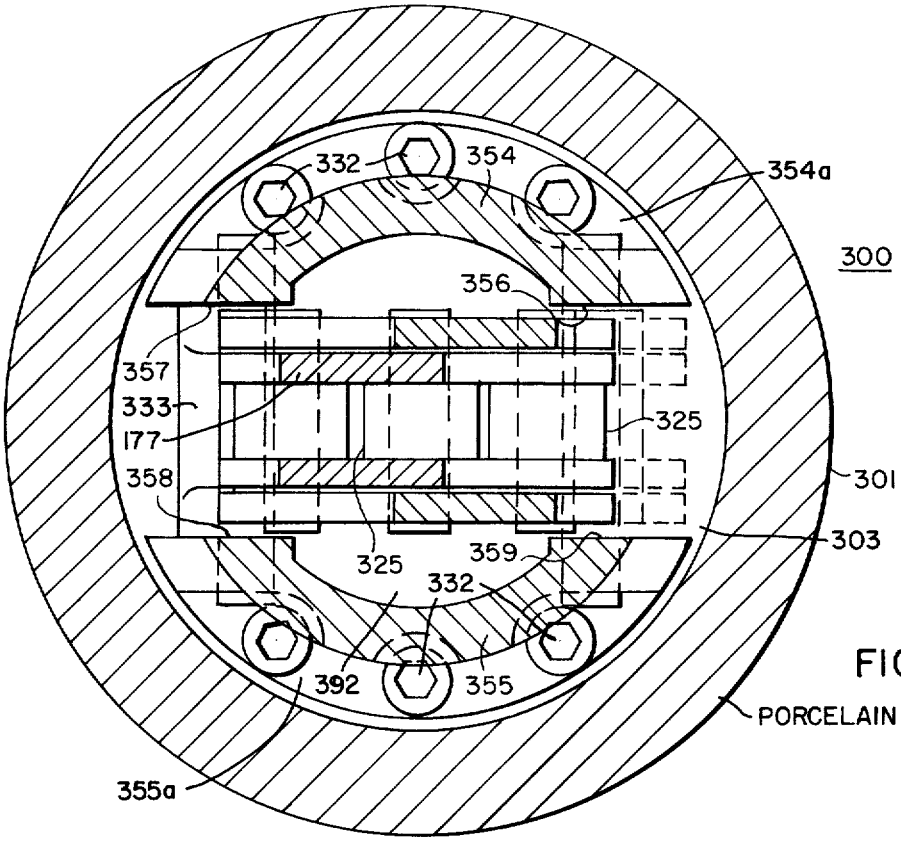
FIGS. 28 is an enlarged sectional view taken substantially along the line XXVIII—XXVIII of FIG. 27.
Figure 29:
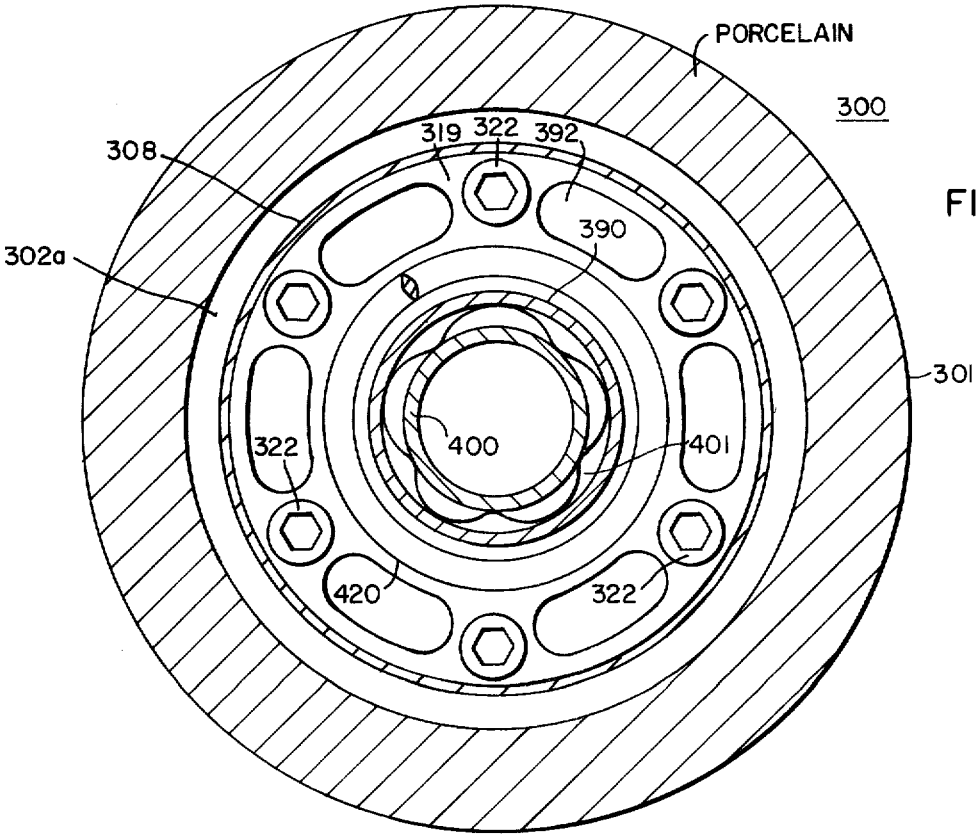
FIG. 29 is an enlarged sectional view taken substantially along the line XXIX—XXIX of FIG. 35.

One additional form of the device which is being disclosed is shown in FIGS. 25, 26 and 27. In these figures, FIG. 25 is a section through the interrupter 300 taken in the closed position, FIG. 26 is a view partially in section taken in the open position, FIG. 27 is a partial section taken at right angles to the section of FIG. 25, FIG. 28 is a section taken along the line XXVIII—XXVIII of FIG. 25, and FIG. 29 is a section taken along the line XXIX—XXIX of FIG. 27.

Referring now to FIG. 25, numeral 301 is a porcelain tube with metallic ends 302, 303 hermetically secured thereto. Extending through the end plate 303 is an operating rod 304 which is guided by the bushing 306 (FIG. 27). A hermetic seal is provided by the metallic bellows 310 which is brazed to the end 303 at 312 and to the rod 304 at 315.

The sylphon bellows 170 that is used is a "Flexonics" reference No. N100 which has a nominal size of 1 × 1½ inches, a pitch of 0.141 inches per convolution, a max deflection of 0.027 in/convolution, a maximum pressure rating of 450 p.s.i., and is available with up to 80 convolutions. The bellows 170 is provided with 35 convolutions which provides a maximum stroke of 0.945 inches of which is used 0.875 inches. Attached to the rod 304 at the pin 320 is a lazy-tong arrangement, designated generally by the numeral 177. The lazy-tong is made up of a group of links such as 61 and 63 together with spacers 325 (FIG. 28) pinned together with a number of pins 330. The links are stamped from aluminum sheet or plate and heat-treated for strength. The lazy-tong 177 is connected to the conduction number 335 (FIGS. 26 and 27) by the pins 340. The lazy-tong provides a motion multiplication of seven times which will multiply the ⅞ in. motion of the rod 335 to 6⅛ inches. Referring to FIG. 26, the output from position *a* has been taken. If the output was taken from position *b*, the motion would be multiplied by 5. This would require 15 more convolutions in the bellows and increase its length by 2.12 in. If the output is taken from point *c*, the multiplier is 3, the bellows 310 would require 80 convolutions, and its length would be increased by 6.35 inches. It will be noted that decreasing the number of steps in the tong 177 actually increases the length of the interrupter 300. On the other hand, increasing the number of steps increases the stress on the bellows end of the linkage. The design shown is selected as a compromise.

A conducting member 350, preferably of copper is bolted to the base 303. Member 350 has four faces which act as guides for the lazy-tongs 177 (see FIG. 28) and keep it from buckling in spite of clearances between the pins and the links. The left-hand end of 350 is circular and is capped by a member 351. Members 350 and 351 are so formed as to provide an annular groove in which a number of sliding ball contacts 360 are mounted (see U.S. Pat. No. 3,301,986). If desired a corrugated sleeve may replace the sliding ball contact 360.

A stirrup shaped member 370 is pinned to the left-hand end of the tongs 177 and this member is threaded to the tubular conducting member 335. Brazed to the left-hand end of the tube 380 is the contact 335 and the conducting cooler 381. Brazed to member 381 is a conducting cylinder 382 which makes contact to member 350 through the sliding ball contacts 360. Insulating flow-guide 385 is threaded into the recess in the member 381.

Bolted to the left-hand end of the housing is a brazed up assembly consisting of an end plate, a tubular, slotted main contact member, a tubular member 390, and a tubular slotted secondary contact member 394. Slidably mounted inside of secondary contact member 394 is arcing contact member 400 which makes contact with 390 through the corrugated sleeve 401. The pin 410 slides in a slot 411 in secondary contact 394 and extends through a hole in 400. A cup member 415 in conjunction with the spring 420 biases the arcing contact to the right until the pin reaches the end of the slot.

In FIGS. 25 and 26 the interrupter is in the closed-circuit position. The current path is from the end conductor 303 to the member 305 to the sliding ball contact 360 to the conducting cylinder 382, to contact and cooler member 381, to main contact 308, to plate 319, to the opposite end member 417. In parallel with main contact member 308 are two other current paths. One is through the secondary contact member 394 and the other is through arcing contact 400 and corrugated sleeve 401.

To open the interrupter, the rod 304 is moved to the right, which works through the tongs 177 to move the cylinder to the right. The first thing that happens is the contact and cooling member 381 separates from main contact member 308, forcing all of the current to pass through the secondary and arcing contacts. As motion continues, contact 335 is withdrawn from contact 394 and the entire current now passes through arcing contacts 400 and 335. Member 400 continues to bear against contact 335 until pin 410 reaches the end of slot 411, at which time the contacts open abruptly and draw an arc. Motion up until this point has compressed the gas in the cylinder 423, but when the arcing contacts separate, the gas blasts the arc and is vented through both hollow contacts, interrupting the arc quickly.

The design as described will have a very high continuous current rating. For a more moderate rating, main contact member 308 would be omitted, member 381 would be cast from aluminum, cylinder 382 would be made from aluminum or plastic, and sliding ball contacts 360 would be relocated so as to form a sliding contact between the member 350 and the tube 380.

As compared to previous puffer-type interrupters, the following improvements are shown:

a. Hermetic sealing.
b. Lazy-tongs to reduce the stroke of the metal bellows to a reasonable length.
c. Main contact system for high continuous current.
d. Secondary contacts.
e. Re-arrangement of mechanical details so that the internal creepage across insulation is the entire length of the porcelain tube.

In more detail, there is provided a stationary main contact cylinder 308 having the right-end thereof slotted, as at 309, to form a plurality of circumferentially disposed main contact fingers, designated by the reference numeral 311. The main metallic contact cylinder 308 is secured, as by a brazing operation, at 313 to the outer periphery of a stationary ring-shaped contact-support plate, designated by the reference numeral 319, and affixed, as by the mounting bolts 322, to the inwardly-extending annular flange portion 302*a* of the end-closure plate 302. FIG. 30 shows this more clearly.

Also secured, as by brazing at 324, to an inner shoulder portion 319*a* of the annular support plate 319, is a contact-tube assembly 394, including an expansion portion 390 (FIG. 30) housing a corrugated contact sleeve 401 (FIG. 29) and having the right-hand end thereof slotted, as at 408, thereby forming a plurality of circumferentially-disposed secondary contact fingers 409, which make sliding contacting engagement in the closed-circuit position, as shown in FIG. 30, with the tubular movable arcing contact 335. The contact-tube assembly 394, in addition, has a pair of diametrically-opposed guide-slots 411, 412, provided therein, more clearly shown in FIG. 30, which limit the longitudinal following motion of a movable guide-pin 410, the latter extending through two diametrically-positioned holes 414 provided in a movable annular spring-support plate 415. A contact-compression biasing spring 420 is interposed between the annular stationary spring-plate 319 and the annular movable spring support plate 415, so that in the closed-circuit position of the device, as illustrated in FIG. 30, the contact spring 420 is compressed, and the guide pin 410 is moved over toward its lefthand extremity position adjacent to the lefthand ends of the guide slots 411, 412, as illustrated in FIG. 25.

Surrounding the contact-tube assembly 394 is a hollow insulating gas-flow nozzle 385 secured, as by a threaded connection 387, to an internal shoulder portion 378 of a movable main contact assembly, designated by the reference numeral 382, and fixedly secured, as by brazing, for example, to the lefthand end of a movable metallic operating cylinder 384. The movable operating cylinder 384 is moved in its opening and closing motions by the lazy-tong motion-multiplying mechanism, designated by the reference numeral 177, and operable from the righthand end of the interrupter assembly 300 by the contact-oprating rod 304. As stated hereinbefore, the contact-operating rod 304 moves with a relatively short motion, whereas the lefthand end of the lazy-tong, or pantograph linkage 177 expands and contracts with a considerable motion-multiplying advantage, as to be gleaned from a comparison of FIGS. 25 and 26 of the drawings.

Affixed upon the support columns 354, 355 (FIG. 28) from the righthand end 303 of the interrupter-assemblage 300 is the relatively-fixed piston structure 351 having one-way-acting valves 353 provided therein, and also supporting an annular outer metallic contact-ring support 350 having a plurality of contact-balls 360 provided in a recess portion 352 of the stationary contact support ring 350.

From the foregoing, it will be apparent that in the closed-circuit position of the device 300, as shown in FIG. 25, the current extends from the lefthand metallic closure-plate 302 through the annular flange portion 302*a*, through the main slotted contact tube 308, through stationary main contacts 311, through the annular movable main contact portion 383 (FIG. 25) of the moving metallic contact assembly 382, through the metallic contact-balls 360, through the stationary supporting contact-ring 350, and through the two longitudinal contact-support standards 354, 355 (FIG. 28), to the righthand end metallic closure-plate 303 of the interrupter 300.

During the opening operation, the inner arcing-tube contact 400, affixed to the movable guidepin 410, moves under the biasing action exerted by the contact compression spring 420 with the movable main-contact assembly 382 toward the right, as viewed in FIG. 25. It will be apparent from an inspection of FIG. 25 that there immediately occurs separation at the main contact fingers 311, 383, thereby causing all of the current to pass through the contact-tube assembly 394, by way of the finger-portions 409 at the righthand extremity thereof, to the arcing nozzle-portion 335 of the movable contact assembly 382, with, of course, some of the current being, additionally, carried by the inner movable biased arcing contact tube 400. This opening action continues until the arcing-nozzle portion 335 separates from the secondary contact fingers 409, which are, of course, stationary, and continued rightward opening movement of the hollow arcing nozzle 335 will, nevertheless, make continued abutting contact with the inner relatively-stationary arcing nozzle 400 until the movable guidepin 410 strikes the righthand ends of the two guide-slots 411, 412. At this point in time an arc (not shown) is established. The position of the parts at this point in time is illustrated in FIG. 30A.

Further continued rightward motion of the movable contact assembly 382 effects a compression of the gas, such as sulfur-hexafluoride ($SF_6$) gas 392 within the compression chamber 397, and forces this gas against the arc and out through the insulating gas-flow nozzle 385 in the direction indicated by the arrows of FIG. 317. Arc extinction soon ensues and the movable contact assembly 382 is further retracted by a collapse of the lazy-tong linkage 177. This position of the parts is indicated in FIG. 31 of the drawings.

It will be observed from the foregoing description that no contact erosion, or arcing erosion, occurs at the main contact structure 311, 383, since all arcing takes place at the secondary contacts 335, 409, or at the inner arcing contacts 335, 400 by virtue of the lost-motion 328 provided by the guidepin 410 moving to the right within the two guide slots 411, 412. Thus, there is provided a pair of inner arcing contacts 335, 400, a set of secondary contacts 335 and 409, and a set of main or tertiary contacts provided by the main contact fingers 311, making contacting engagement with the outer main contacting periphery portion 383 of the movable metallic operating cylinder 384. Thus, arcing is limited to the inner two arcing contacts 335 and 400, where the gas-flow, generated from the compression chamber 397, rapidly blasts the arc and causes its extinction.

With reference to FIGS. 27 and 28, it will be observed that a pair of cooperating arcuately-shaped contact-support standards 354, 355 are provided having end-flanged portions 354*a*, 355*a*, which are bolted, by a plurality of bolts, 332, say, for example, six in number, to the right-hand end-support plate 303 of the interrupter assembly 300. The spacing 333 between the two contact guide-standards affords a longitudinal guiding raceway for accommodating accurate expansion and contraction of the lazy-tong linkage 177. This is more clearly illustrated in FIG. 28. In addition, the contact-standards 354, 355 as shown more clearly in FIG. 27, fixedly support into a stationary position the contact support ring 350.

The lefthand end 340 of the lazy-tong linkage 177 is pivotally secured to an apertured adaptor 370 having lateral holes 371 provided therethrough, and threadedly secured to the righthand end of the arcing contact-tube 380. Since the arcing contact tube 380 has the arcing nozzle 335 affixed thereto, together with the metallic cooler assembly 381, the latter supporting the outer metallic operating cylinder 384, it will be apparent that the entire movable contact assembly 382, comprising the metallic operating cylinder 384, the metallic cooler 381, the movable main contacts 383, and the inner arcing nozzle contact 335, move rightwardly during the opening operation as a unitary contact assembly being actuated by the collapsing action of the lazy-tong linkage, or pantograph assembly 177. The collapsed position is, as mentioned, set forth in FIG. 26 of the drawings.

Although there have been illustrated and described specific structures, it is to be clearly understood that the same were merely for the purpose of illustration, and that changes and modifications may readily be made therein by those skilled in the art without departing from the spirit and scope of the invention.

I claim:

1. A gas-type puffer circuit-interrupter comprising a sealed-casing structure having a relatively stationary contact disposed adjacent one end thereof and a movable contact cooperable with said stationary contact and operable out of an apertured plate at the other end of said sealed-casing structure, a movable contact operating rod extending interiorly into the sealed-casing structure to operate the movable contact therein, a sylphon bellows sealed to one end of said end plate of the sealed-casing structure through which the movable contact rod extends, the other end of the sylphon bellows being sealed to an intermediate portion of the movable contact-operating rod, a lazy-tong motion-multiplying operating linkage mechanism interposed between the inner end of the movable contact operating rod and the movable contact structure, a longitudinally-extending guide-means for the lazy-tong operating mechanism having one end affixed to the said apertured end plate and the other end supporting a fixed piston structure, said movable contact carrying a movable operating cylinder slidable longitudinally over said fixed piston structure to provide gas flow, an insulating nozzle secured to said movable contact structure whereby compression of gas between the movable operating cylinder and the fixed piston structure will force compressed gas out through the movable nozzle structure to effect extinction of the arc drawn between the stationary and movable contacts.

2. The combination according to claim 1, wherein four angle brackets constitute said longitudinally-extending guide-means.

3. The combination according to claim 2, wherein roller members are affixed to the movable pivots of the lazy-tong operating mechanism and slides between the confronting faces of the four angle-members of the guide-means.

* * * * *